US006665415B1

(12) United States Patent
Heed

(10) Patent No.: US 6,665,415 B1
(45) Date of Patent: Dec. 16, 2003

(54) LOUDSPEAKER OVERCURRENT PROTECTION

(75) Inventor: Thomas P. Heed, Greenwood, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/392,847

(22) Filed: Sep. 9, 1999

(51) Int. Cl.[7] ..... H04R 25/00

(52) U.S. Cl. ..... 381/410; 381/396; 381/409; 381/412; 381/403

(58) Field of Search ..... 381/400, 164, 381/396, 409, 410, 412

(56) References Cited

U.S. PATENT DOCUMENTS

| | | | | |
|---|---|---|---|---|
| 3,544,720 | A | | 12/1970 | Corderman |
| 3,568,122 | A | * | 3/1971 | Urani |
| 3,783,179 | A | * | 1/1974 | Ferber |
| 3,925,708 | A | | 12/1975 | Picciochi |
| 3,954,572 | A | * | 5/1976 | Ziegler |
| 3,959,736 | A | | 5/1976 | GrosJean |
| 4,301,330 | A | * | 11/1981 | Trump |
| 4,583,245 | A | * | 4/1986 | Gelow |
| 5,019,457 | A | * | 5/1991 | Nishio |
| 5,198,791 | A | * | 3/1993 | Shibayama |
| 5,224,169 | A | | 6/1993 | Morris, Jr. et al. |
| 5,682,057 | A | * | 10/1997 | Kuriyama |
| 5,838,809 | A | * | 11/1998 | Sato |
| 5,847,610 | A | | 12/1998 | Fujita |
| 6,236,733 | B1 | * | 5/2001 | Kato |

FOREIGN PATENT DOCUMENTS

| | | | |
|---|---|---|---|
| JP | 200090747 | * | 2/2000 |

* cited by examiner

*Primary Examiner*—Curtis Kuntz
*Assistant Examiner*—Dionne N. Harvey
(74) *Attorney, Agent, or Firm*—Brinks Hofer Gilson & Lione

(57) ABSTRACT

A transducer includes a motor assembly for providing a magnetic field across an air gap, a voice coil supported in the air gap, a diaphragm coupled to the voice coil for reciprocation with the voice coil, and conductors for coupling opposite ends of the voice coil to a source of alternating current to cause the voice coil to reciprocate in the air gap. At least some portion of the length of at least one of the conductors is fusible when exposed to a direct current having a magnitude greater than the maximum desired magnitude of direct current to which it is desired to expose the voice coil.

19 Claims, 1 Drawing Sheet

LOUDSPEAKER OVERCURRENT PROTECTION

FIELD OF THE INVENTION

This invention relates to transducers. It is disclosed in the context of an electrodynamic loudspeaker, but is believed to have utility in other applications as well.

BACKGROUND OF THE INVENTION

Schemes for the protection of loudspeaker voice coils from excessive current are known. There are, for example, the schemes described in U.S. Pat. Nos. 3,544,720; 3,925,708; 3,959,736; 5,224,169; and, 5,847,610. There are also the loudspeakers disclosed in U.S. Pat. No. 5,838,809. This listing is not intended as a representation that a thorough search of the prior art has been conducted or that no more pertinent art than that listed above exists, and no such representation should be inferred.

BRIEF DESCRIPTION OF THE DRAWINGS

The invention may best be understood by referring to the following detailed description and accompanying single drawing FIGURE which illustrates the invention. The single FIGURE illustrates a fragmentary cross-section through a loudspeaker constructed according to the invention.

DISCLOSURE OF THE INVENTION

Figure 1:
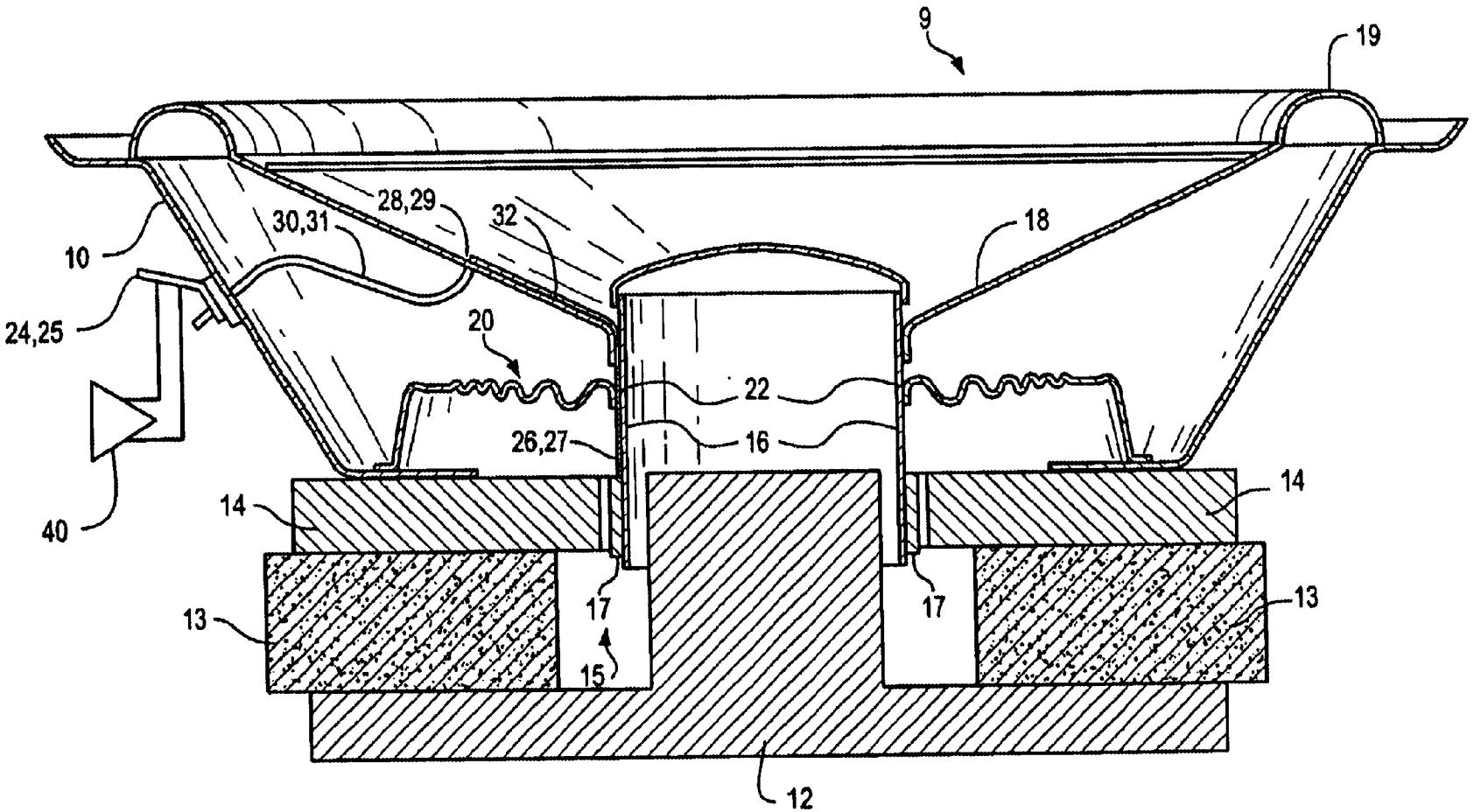

According to the invention, a transducer includes a motor assembly for providing a magnetic field across an air gap, a voice coil supported in the air gap, a diaphragm coupled to the voice coil for reciprocation with the voice coil, and conductors for coupling opposite ends of the voice coil to a source of alternating current to cause the voice coil to reciprocate in the air gap. At least some portion of the length of at least one of the conductors is fusible when exposed to a direct current having a magnitude greater than the maximum desired magnitude of direct current to which it is desired to expose the voice coil.

Illustratively according to the invention, the said portion of the length of the at least one conductor is formed from material having resistance per unit length which results in said portion of the length of the at least one conductor being fusible when exposed to direct current having magnitude greater than the maximum desired magnitude.

Illustratively according to the invention, the length of one of the conductors is fusible when exposed to direct current having magnitude greater than the maximum desired magnitude.

Illustratively according to this aspect of the invention, the length of one of the conductors is formed from material having resistance per unit length which results in said one conductor being fusible when exposed to direct current having magnitude greater than the maximum desired magnitude.

Additionally illustratively according to the invention, the lengths of both of the conductors are fusible when exposed to direct currents having magnitudes greater than the maximum desired magnitude.

Illustratively according to this aspect of the invention, the lengths of both of the conductors are formed from materials having resistances per unit length which results in the conductors being fusible when exposed to direct currents having magnitudes greater than the maximum desired magnitude.

Further illustratively according to the invention, at least some portion of the lengths of both of the conductors are fusible when exposed to direct current having magnitude greater than the maximum desired magnitude.

Illustratively according to this aspect of the invention, the said portions of the lengths of both of the conductors are formed from materials having resistances per unit length which result in said portions of the lengths of both of the conductors being fusible when exposed to direct currents having magnitudes greater than the maximum desired magnitude.

Detailed Descriptions of Illustrative Embodiments

Referring now to FIG. 1, a loudspeaker 9 includes a supporting frame 10 and a motor assembly. The illustrated motor assembly includes a backplate/center pole 12, a permanent magnet 13, and a front plate 14 providing a substantially uniform magnetic field across an air gap 15. A voice coil former 16 supports a voice coil 17 in the magnetic field. Current related to the program material to be transduced by the loudspeaker 9 drives the voice coil 17, causing it to reciprocate axially in the air gap 15 in a known manner. A cone 18 attached at its apex to an end of the coil former 16 lying outside the motor assembly is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15.

A typical, although by no means the only, mechanism for completing the electrical connection between the loudspeaker terminals 24, 25 and the voice coil wires 26, 27 is illustrated in the FIGURE. The voice coil wires 26, 27 are dressed against the side of the coil former 16, and pass through central opening 22 and the intersection of the coil former 16 and the apex of the cone 18. Wires 26, 27 are then dressed across the face 32 of the cone 18 to the points 28, 29 on the face of the cone 18 where they are connected to the flexible conductors 30, 31. Connections 28, 29 are made by any of a number of available techniques. The coil wires 26, 27 illustratively are fixed to the face 32 of the cone 18 with (an) electrically non-conductive adhesive(s).

When the voice coil 17 is exposed to direct current, for example, accidentally during connection of the loudspeaker into the output circuit of an audio amplifier 40 or during a malfunction of such an audio amplifier 40, voice coil 17 can be damaged sufficiently that a short circuit develops in voice coil 17. A short circuited voice coil can become further overheated, with adverse consequences. Some audio amplifiers 40 are not capable of handling short circuited voice coils or other problems which develop as results of the short circuiting of voice coils. As noted above, in most loudspeakers, the ends 26, 27 of the voice coil 17 are normally coupled through connections 28, 29 to flexible conductors 30, 31, and through these conductors 30, 31 to the audio amplifier 40 output circuitry. It is quite common to use so-called litzendraht, or litz, wire, a highly flexible, woven wire for conductors 30, 31.

The present invention employs litz, or other suitable type wire, which performs normally in the presence of alternating current, such as normally appears across the output terminals of an audio amplifier 40, but opens when exposed to a direct current having greater than a certain arbitrary magnitude. Under normal conditions, therefore, conductors 30, 31, behave as any prior art conductors in this position in a loudspeaker. However, when exposed to a direct current having a magnitude greater than the established maximum, the conductors 30, 31 melt over, for example, five to ten seconds, opening the circuit to the voice coil 17 and reducing the likelihood of any adverse consequences of the exposure to direct current that the loudspeaker 9 or the audio amplifier 40 driving it might otherwise experience. This slow melting characteristic is achieved in the illustrative embodiment by choosing a material for conductors 30, 31 which has sufficiently high resistance per unit length that it is heated to its melting temperature by a direct current having a magnitude equal to or greater than the arbitrarily established maximum which is sustained over, in this example, five to ten seconds. This can be achieved in any of a number of ways, for example, by choosing (an) appropriate alloy(s) for some portion or all of the length(s) of one or both of conductors 30, 31.

For example, in a loudspeaker 9 having a voice coil 17 with a nominal impedance of 4Ω, it may be desirable to provide at least one conductor 30, 31 having at least a portion of its length fusible under sustained direct current greater than 3.8 amperes.

What is claimed is:

1. A transducer including a motor assembly for providing a magnetic field across an air gap, a voice coil supported in the air gap, a diaphragm coupled to the voice coil for reciprocation with the voice coil, and a plurality of litz wires for coupling opposite ends of the voice coil to a source of alternating current to cause the voice coil to reciprocate in the air gap, at least some portion of the length of at least one of the litz wires being fusible when exposed to a direct current having a magnitude greater than the maximum desired magnitude of direct current that the voice coil may be exposed to without damage.

2. The apparatus of claim 1 wherein the length of one of the litz wires is fusible when exposed to direct current having magnitude greater than the maximum desired magnitude.

3. The apparatus of claim 1 wherein the lengths of both of the litz wires are fusible when exposed to direct currents having magnitudes greater than the maximum desired magnitude.

4. The apparatus of claim 1 wherein at least some portion of the lengths of both of the litz wires are fusible when exposed to direct current having magnitude greater than the maximum desired magnitude.

5. The apparatus of claim 1 wherein the length of one of the litz wires is formed from material having resistance per unit length which results in said one of the litz wires being fusible when exposed to direct current having magnitude greater than the maximum desired magnitude.

6. The apparatus of claim 1 wherein the lengths of both of the litz wires are formed from materials having resistances per unit length which results in the litz wires being fusible when exposed to direct currents having magnitudes greater than the maximum desired magnitude.

7. The apparatus of claim 4 wherein the said portions of the lengths of both of the litz wires are formed from materials having resistances per unit length which result in said portions of the lengths of both of the litz wires being fusible when exposed to direct currents having magnitudes greater than the maximum desired magnitude.

8. The apparatus of claim 1 wherein the said portion of the length of the at least one litz wire is formed from material having resistance per unit length which results in said portion of the length of the at least one litz wire being fusible when exposed to direct current having magnitude greater than the maximum desired magnitude.

9. A transducer that includes a frame, a cone coupled with the frame, a voice coil former coupled with the cone, a voice coil coupled with the voice coil former and a loudspeaker terminal coupled with the frame, the loudspeaker terminal operable to receive signals from an audio amplifier, the transducer further comprising:

a voice coil wire that forms the voice coil; and a litz wire electrically connected between the voice coil wire and the loudspeaker terminal, at least a portion of the litz wire operable to melt in the presence of a sustained direct current applied to the loudspeaker terminal that is greater than an established maximum, wherein the established maximum is less than a predetermined magnitude of sustained direct current that will cause a short circuit to develop in the voice coil.

10. The transducer of claim 9, where only the litz wire is operable to melt after exposure to the sustained direct current greater than an established maximum for a determined period of time.

11. The transducer of claim 9, where the litz wire is operable to stop conducting in response to melting.

12. The transducer of claim 9, where the voice coil wire is fixedly attached to the cone.

13. The transducer of claim 9, where the litz wire is suspended in air between the cone and the loudspeaker terminal.

14. The transducer of claim 9, where the litz wire is electrically connected to the voice coil wire on a face of the cone.

15. The transducer of claim 9, where the litz wire is operable to flex in response to reciprocation of the voice coil.

16. A transducer that includes a loudspeaker terminal for receiving program material from an audio amplifier and a voice coil driven by the program material, the transducer comprising:

a litz wire operable to conduct program material in the form of an alternating current signal from the loudspeaker terminal to the voice coil, where only the litz wire is operable as a fuse to stop conducting in response to the presence on the litz wire of direct current greater than an established maximum, wherein the established maximum is previously determined and is less than a magnitude of direct current that causes adverse consequences to be experienced by one of the voice coil and the audio amplifier.

17. The transducer of claim 16, where the voice coil reciprocates in response to the program material, the litz wire operable to flex in response to reciprocation of the voice coil.

18. The transducer of claim 16, where at least some portion along the length of the litz wire is operable to melt in the presence of direct current greater than the established maximum.

19. The transducer of claim 16, where the voice coil has a nominal impedance of about 4 ohms and the established maximum is about 3.8 amperes of direct current.

* * * * *